United States Patent [19]

Blauer

[11] 4,294,052

[45] Oct. 13, 1981

[54] PREFABRICATED LOAD BEARING STRUCTURE

[76] Inventor: Aaron Blauer, 386 Strathcona Dr., Town of Mount Royal, Quebec, Canada

[21] Appl. No.: 95,400

[22] Filed: Nov. 19, 1979

[51] Int. Cl.[3] ..... E04H 1/00

[52] U.S. Cl. ..... 52/236.5; 52/236.8; 52/266; 52/690; 52/264; 52/745

[58] Field of Search ..... 52/236.7, 236.8, 266, 52/690, 648, 264, 236.5, 236.6, 236.3, 481, 745, 270; 403/241, 240, 244, 263

[56] References Cited

U.S. PATENT DOCUMENTS

| | | | |
|---|---|---|---|
| 1,821,015 | 9/1931 | Hull | 52/236.7 X |
| 1,893,636 | 1/1933 | Ridgway | 52/272 |
| 2,076,728 | 4/1937 | Keller | 52/236.7 X |
| 2,124,519 | 7/1938 | Piersen et al. | 52/272 |
| 2,191,804 | 2/1940 | O'Malley | 52/584 X |
| 2,883,852 | 4/1959 | Midby | 52/236.8 |
| 4,074,487 | 2/1978 | Daniels et al. | 52/236.3 |
| 4,130,970 | 12/1978 | Cable | 52/648 X |

*Primary Examiner*—Price C. Faw, Jr.

*Assistant Examiner*—Carl D. Friedman

*Attorney, Agent, or Firm*—Swabey, Mitchell, Houle, Marcoux & Sher

[57] ABSTRACT

A multi-storey building construction utilizing prefabricated metal panels of tubular construction which can be erected at the job site by unskilled labor and adapted to support vertically spaced-apart floors, whereby the plurality of floors are separated by parallel rows of walls, each wall comprising the tubular metal panels. Each row of walls is in vertical alignment but not in direct contact with corresponding rows of walls situated on vertically adjacent floors, and each vertically adjacent row is interconnected by high-tensile strength threaded fasteners rigidly interconnecting the upper and lower chord of each panel to an adjacent chord of a vertically adjacent panel. The rows of vertically interconnected prefabricated metal panels provide effective continuous lightweight shear walls extending from the foundation of the building to the roof. The shear walls support loads imposed on the building and provide stiffness to the building to resist natural forces which otherwise tend to overturn the building.

11 Claims, 7 Drawing Figures

PREFABRICATED LOAD BEARING STRUCTURE

BACKGROUND OF THE INVENTION

1. Field of the Invention

The invention relates to the construction of buildings, and in particular to an improved method of constructing a high-rise or multi-storey building utilizing prefabricated steel panels, and a building made according to this method.

2. Description of the Prior Art

While the use of prefabricated metal panels is known in the prior art, such panels have been limited in their applications to use in the construction of residential or low-rise commercial buildings. Such constructions have been known in the construction industry for several years, but have not been adopted in the construction industry today as being a feasible method of constructing high-rise building structures.

In particular, U.S. Pat. No. 2,076,728 to Keller discloses the use of prefabricated metal structural units which can be transported to the job site, together with a prefabricated floor and roof units, to be erected into a residential type building. This patent, however, does not disclose the direct connection between vertically adjacent panels, but rather utilizes a complicated three-way connection between the vertically adjacent panels and a superimposed prefabricated floor structure situated therebetween. Such a building structure does not provide a shear wall type of construction which is essential today in wall structures utilized for high-rise or multi-storey buildings. By shear wall type, it is meant a construction which will resist lateral forces as well as vertical load bearing. As a result, the structure according to this patent does not provide an effective continuous stiff wall-type of structure from the foundation to the top of the building and could not, therefore, meet the structural requirements associated with wall structures utilized in high-rise construction today.

A similar type of building construction unit to the Keller building structure is disclosed in U.S. Pat. No. 2,191,804 to O'Malley. This patent likewise deals with frame sections which can be utilized for the wall partitions, or other parts of a dwelling house, or other small buildings. As in the Keller patent, this disclosure likewise does not make provision for an effective stiff continuous wall structure from the foundation of the building to the top thereof, utilizing prefabricated building construction units. Both the above patents require expensive and interfering horizontal bridging and diagonal bracing between the vertical studs.

That the prior art methods of utilizing prefabricated metal panels in the erection of a building are not feasible in the construction of high-rise buildings is clearly apparent from the presently utilized methods in the construction industry today. In particular, the present methods of erecting a high-rise or multi-storey structures utilize columns extending the height of the building which are of poured concrete construction. The floors of the building are made from poured concrete and necessitate the erection of a temporary supporting structure to permit the pouring of the concrete and to support the poured concrete in place during curing thereof. The supporting structure most frequently utilized today comprises a large number of the screw-type jacks which are spaced quite closely together, approximately 2 or 3 feet, and support layers of plywood are placed on flat plates situated at the upper end of each jack. This method of construction has a number of drawbacks which, to date, have not been overcome by any known method of constructing high-rise buildings.

One of the obvious drawbacks of the present system of erecting high-rise buildings, noted above, is the fact that the erection of the jacks and the placing thereon of the plywood supporting surface for the concrete is quite time-consuming, and in view of labour costs today, considerably increases the cost of construction of a building. Additionally, due to the close spacing of the screw-type jacks, the area in which the jacks are erected cannot be worked in until the curing of the poured concrete floor thereabove is completed. In this respect, the curing time of such a concrete floor, depending upon the thickness thereof, may be of the order of two to twelve weeks. After the curing process is completed, it is then necessary to dismantle the screw-type jacks and to remove the plywood supported thereby, further adding to the inefficiency of this process.

Additionally, the wall structures within the interior of the building are today manufactured from reinforced concrete or masonry. However, there are a number of drawbacks with the use of wall structures of this kind. In particular, in the case of prefabricated reinforced, concrete walls, handling thereof becomes a problem due to their considerable weight, and they are also subject to damage during handling due to their brittleness. On the other hand, in the case of walls made from concrete blocks at the site, construction thereof is time-consuming and, therefore, expensive. As an additional factor, such concrete block walls necessitate the use of temporary shoring to hold them in place until the floor of the next level is completed. In a situation where shoring is not used to support the masonry wall prior to completion of the floor above, the wall is subject to the varying weather conditions and can be blown over by the wind, thereby necessitating rebuilding of the wall.

A further drawback associated with reinforced concrete and masonry walls is their excessive weight. Since the foundation of the building is built in accordance with the total weight of the building, the cost of the foundation increases considerably due to the additional weight of reinforced concrete and block walls which it must support.

A further factor which detracts from the use of reinforced concrete or block walls is the necessity of heating such wall structures during the winter-time construction thereof in order to permit the proper curing of the concrete or mortar. Certainly, this problem becomes more pronounced in colder climates and adds to the construction of the building which is taking place during the winter months. Proper curing of the concrete or mortar used in the reinforced concrete or block walls is effected by placing tarpaulins around the concrete or masonry block walls and subjecting the same to heat from a temporary source of heat for a period of three to four days during the curing of the mortar or concrete. As well, erection of such walls necessitates the use of skilled labour.

SUMMARY OF THE INVENTION

The present invention proposes to overcome the drawbacks associated with the known existing methods of constructing high-rise or multi-storey building by utilizing prefabricated steel panels of tubular construction which can be erected at the job site by unskilled labour, necessitating only that the workmen tighten down nuts on the portions of the threaded fasteners extending above the upper surface of the lower chord of the panels after the same have been mounted in position. This precludes the necessity of direct contact between vertically adjacent upper and lower panels. After the nuts have been tightened by the workmen, the resulting walls formed from the prefabricated panels are self-supporting laterally and do not require temporary shoring to support them in position, as in the case of reinforced concrete or block walls. Further, cold temperatures do not affect the installation of the prefabricated panels according to the present invention, as in the case of walls which necessitate the curing of concrete or mortar for an extending period of time. As a result, a wall built with prefabricated panels according to the present invention is temporarily self-supporting in the lateral direction during construction and, therefore, not susceptible to the disadvantages of reinforced concrete or block walls. Further, the weight of the walls utilizing the present invention is a small fraction of the weight associated with similar reinforced concrete or block walls which are capable of supporting the same load. Further, walls made from the prefabricated steel tubing are not susceptible to damage during transport and erection, as in the case of prefabricated concrete and prefabricated block walls.

A substantial advantage is derived from using the method and building construction according to the present invention in that a building construction is provided by means of threaded fasteners interconnecting vertically adjacent prefabricated panels such that an effective continuous wall structure is provided from the foundation to the roof of the building. Thus, threaded fasteners not only support the prefabricated panels in place prior to construction of the floor above, but also permit a form of shear transfer between the floor and the resulting wall structures. Shear walls not only support bearing loads from the floors above, as in the case of standard bearing walls, but also act as stiffeners to resist overturning of the building due to wind forces or forces created during an earthquake. The walls provided by the method according to the present invention thus function as stiffener walls by utilizing the threaded fasteners to interconnect vertically adjacent panels as well as supporting the bearing loads of the floors thereabove. In presently constructed buildings, shear walls may be made from poured concrete having a length of approximately 20 feet and a width of 8 inches, and extend continuously the entire height of the building. Such concrete walls likewise function as huge stiffeners to prevent the building from bending about a horizontal axis. However, such a shear wall construction is not only time-consuming to erect, but also adds considerably to the weight of the building and, therefore, to the cost of the foundation to support the additional building weight.

This invention can be used equally in buildings with concrete slab floors, or in buildings with concrete floors supported by steel joists or beams. The advantages of the steel joist method are that no shoring is required since the joists are of course supported by the steel walls. Furthermore, the space between the joists and the depth of the joists permits central mechanical and electrical installation thereby reducing the expense thereof.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
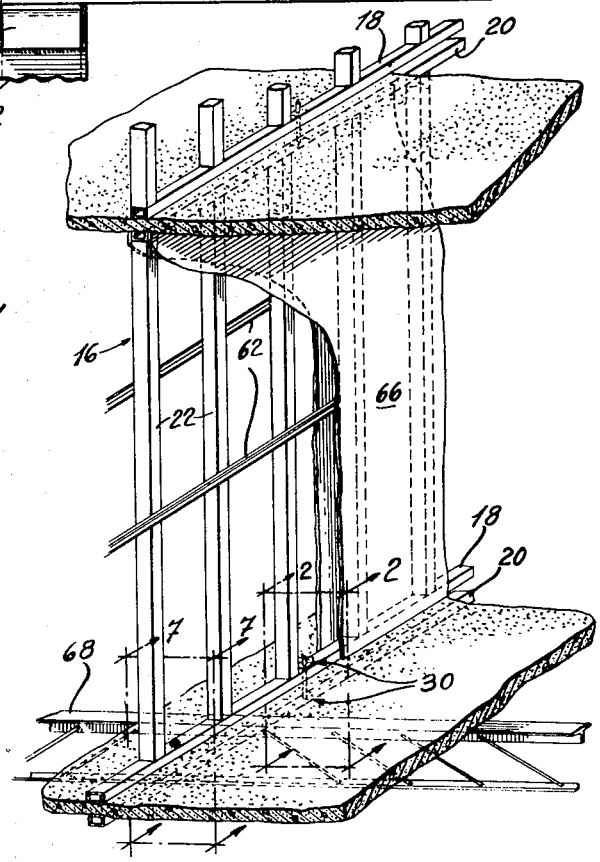
FIG. 1 is a perspective view of a portion of a high-rise or multi-storey building, broken away to illustrate the constructional features thereof.

As best illustrated in FIG. 1, the portion of a high-rise or multi-storey building includes poured concrete floors 10 and 12 formed during the construction thereof. Both poured concrete floors 10 and 12 are supported during the curing of the concrete by temporary shoring indicated generally by reference number 14. The upper surface of each poured concrete floor supports the series of prefabricated steel panels 16 of tubular construction. Each panel 16 includes a lower horizontal chord 18 and an upper horizontal chord 20, the lower and upper chords being interconnected by spaced-apart vertical studs 22 which are welded at opposite ends thereof to the respective horizontal chords.

Figure 2:
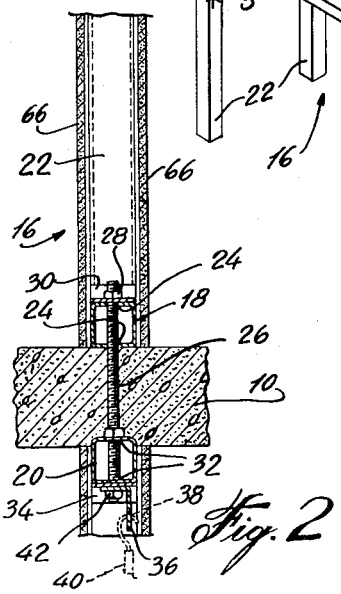
FIG. 2 is an enlarged vertical section taken along line 2—2 of FIG. 1.

The lower chord 18 rests on the surface of the concrete floor and, as best illustrated in FIG. 2, includes vertical openings 24 which receive the upper portions of bolts 26 extending above the surface of the concrete floor 10. The bolt 26 is secured to the upper chord 20 of the prefabricated panel situated vertically beneath the panel 16.

After the prefabricated panel 16 is located in position on the upper bolt portions, the prefabricated panels are retained in position by means of nuts 28 which are secured to the upper ends of the bolts 26 and are tightened in position. The lower chord 18 of the panel 16 is provided with reinforcing channel portions 30 in line with vertical openings 24 and also having aligned openings therein for receiving the upper bolt portions. The reinforcing angle portions 30 are welded to the upper surface of the lower chord 18 and stud 22 and are designed to reinforce the lower chord and thereby prevent bending thereof during tightening of the nuts 28.

The upper chord 20 of each panel 16 is also provided with vertical openings 32 for receiving the lower portions of the high-tensile anchor bolts 26. The openings 32 in the upper chord 20 are aligned with the correponding vertical openings 24 in the lower chord 18 of the vertically adjacent panels to permit alignment of the openings during installation of the panels. The lower surface of the upper chords 20 are likewise provided with respective channel portions 34 adjacent vertical openings 32 in the upper chords 20.

The high-tensile anchor bolts 26 also support angle pieces 36 within the reinforcing channels 34. The angle pieces 36 are provided with an opening 38 in the downwardly extending leg portion, the opening 38 designed to support a hook of a chain block 40, illustrated in phantom in FIG. 2, the block and tackle 40 being used to raise or lower shoring used for constructing the upper poured concrete floor.

As best seen in FIG. 2, the high-tensile anchor bolt 26 extends upwardly through the vertical opening in the upper chord 20 of the panel 16, with the nut 42 bearing against one leg of the angle piece 36.

Figure 7:
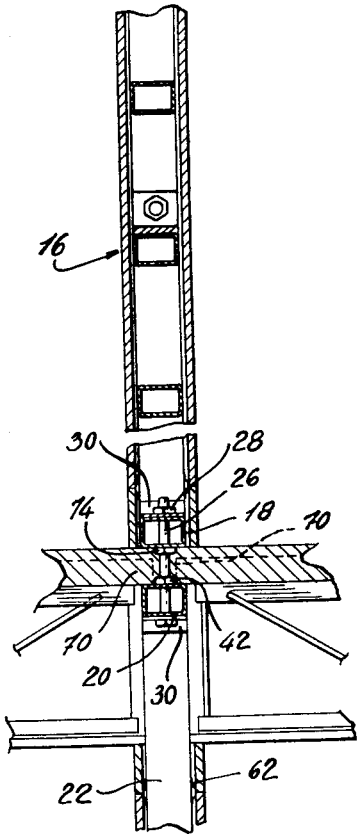
FIG. 7 is an enlarged vertical section taken along line 7—7 of FIG. 6.

A construction is illustrated in FIGS. 1 and 7. In this construction, panels 16 support permanent steel joists 68, utilized to support the concrete floor 10. The use of steel joists permits the use of a concrete floor having a depth lesser than that using no steel support. The use of steel joists, however, has the disadvantage that the depth of the joists lowers the effective usable vertical space between the lower surface of the joists and the floor situated therebeneath. Nevertheless, the use of steel joists can be utilized depending on the building application. The advantages of the steel joist method are that no shoring is required since the joists are of course supported by the steel walls. Furthermore, the space between the joists and the depth of the joists permits central mechanical and electrical installation thereby reducing the expense thereof.

As shown in FIG. 7, the steel joists 68 have shoe portions 70 which extend outwardly beyond the end of the joist from an upper surface thereof, the lower surfaces of the shoe portions resting on the upper surface of the upper chord 20 of the panel 16. The series of aligned joists are thereby supported by the upper surfaces of the panels 16 at approximately 24 inch centers, with each third or fourth joist being welded in position to the panel 16 to provide rigidity and to support the upper ends of the panels in position. Plywood is then supported in position by the joists and the concrete is then poured over the plywood. The upper portions of the joists are thus supported in the concrete, and the plywood is stripped from the lower surface of the floor after curing of the concrete is completed.

It should further be noted, as illustrated in FIG. 7, that the upper panel 16 can be installed in position prior to pouring of the concrete floor. To achieve this, a third nut 74 is mounted on the high tensile anchor 26 at a distance spaced above the nut 42. The upper surface of the nut 74 corresponds to the floor level of the concrete floor to be poured. The panel 16 can then be placed on the anchor bolt 26 and temporarily held in position by the studs 74 and secured thereto by the nuts 28. In this way, erection of vertically adjacent walls can be effected prior to pouring of the concrete floor between the vertically adjacent walls.

Figure 4:
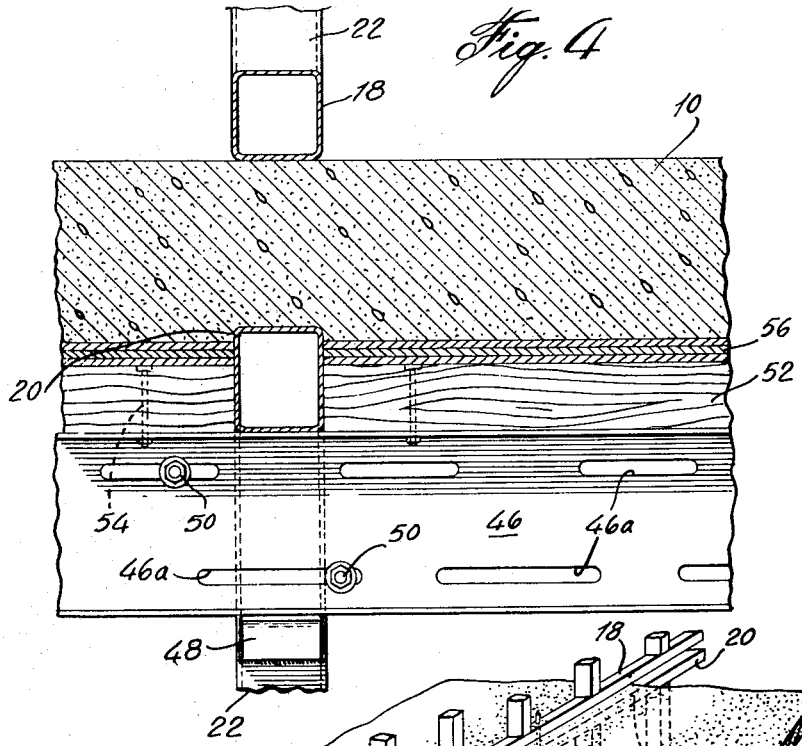
FIG. 4 is a side view taken along line 4—4 of FIG. 3.
Figure 6:
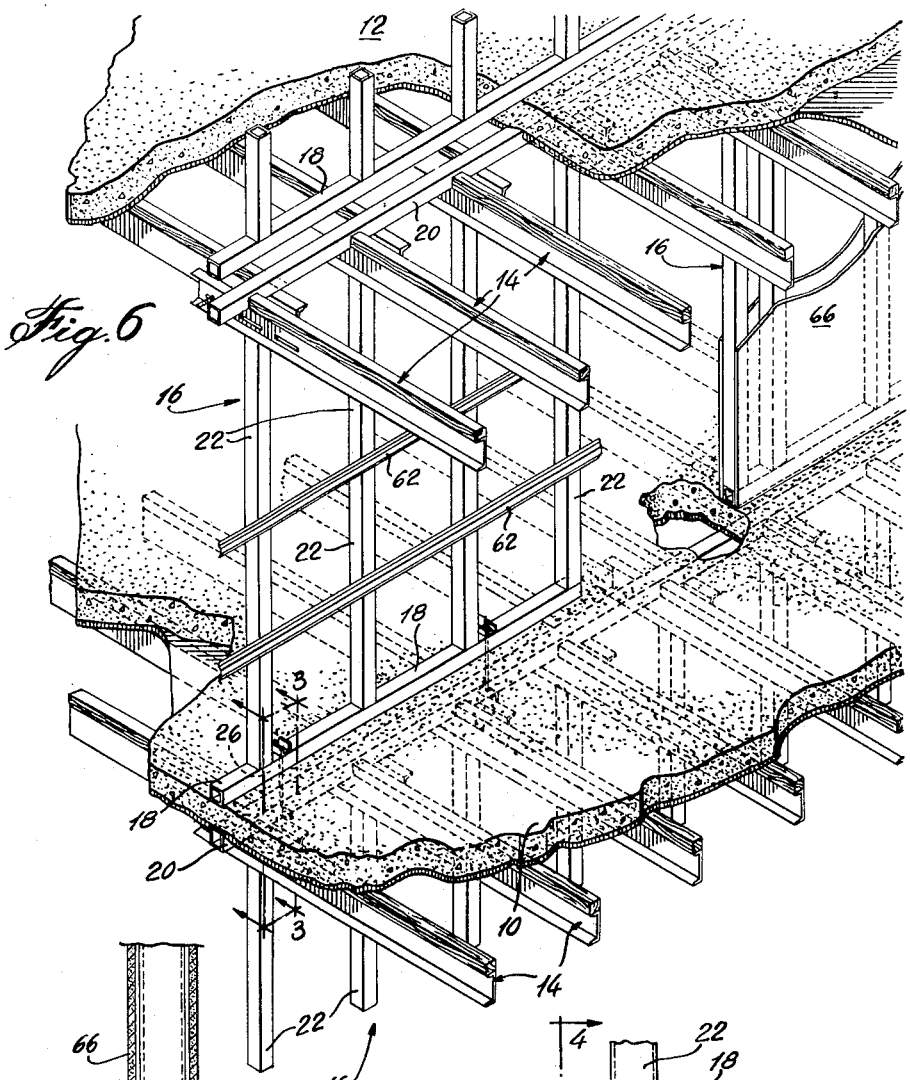
FIG. 6, which is on the same sheet as FIG. 4, is a perspective view of a further embodiment of a portion of a high-rise or multi-storey building fabricated according to the present invention, partly broken away to illustrate the constructional features thereof.
Figure 3:
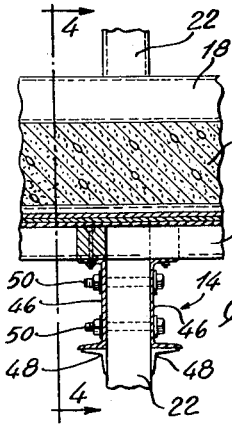
FIG. 3 is an enlarged vertical section taken along line 3—3 of FIG. 1.

In the embodiment shown in FIGS. 6 and 3, prior to pouring the upper concrete floor, temporary shoring 14 is installed in position. The temporary shoring 14 includes channel members 46 having aligned horizontal slots therein, adjacent the ends thereof, as best seen in FIG. 4. The channels are raised into position utilizing the block and tackle 40 and rest on angle members 48 which are welded on side surfaces of vertical studs 22, as best seen in FIG. 3, at locations spaced from the upper chord 20. The channel members 46 rest on the angle members 48 and two channel members 46 are supported by each vertical stud 22 and are secured together by means of bolts 50 extending through the horizontal slots **46*a* in the channel members 46, as best seen in FIGS. 3 and 4. The channel members 46 are of such a length as to extend between horizontally adjacent walls comprising the prefabricated steel panels and to extend slightly beyond the wall portions, such that each channel member 46 is releasably secured to its adjacent channel member by means of bolts 50 located on both sides of the stud 22. The arrangement of slot 46*a* in the channel members 46 permits the use of random lengths of channels 46. Thus, the channels may be reusable without modification. Wood fillers 52 are releasably mounted to the upper surface of the channel members 46 by means of suitable fasteners 54. Plywood 56 is then placed on top of the wood fillers 52 so that the plywood lies loosely on the wood fillers 52. An upper portion of the upper chord 20 projects slightly upwardly of the upper surface of the loose lying plywood 56, so as to provide a keying action with the poured concrete floor, as illustrated in FIG. 2. The channel members 46 can be replaced by wide flange members which have been suitably modified to permit temporary securing together adjacent the ends thereof, in the same manner as illustrated in FIGS. 3 and 4**.

Figure 5:
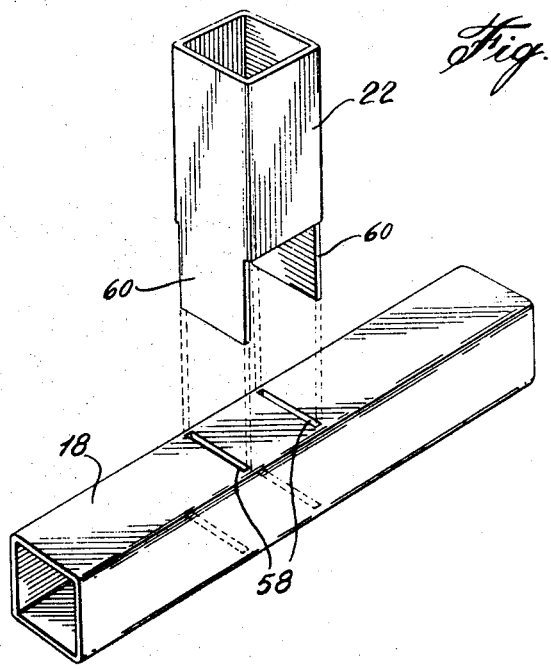
FIG. 5 is a perspective view of one embodiment of the method of constructing the prefabricated metal panels.

The method of attaching the steel studs 22 to the respective chords 18 and 20 will vary depending upon the bearing load to be supported by the panel. For example, under normal loading conditions, the vertical studs 22 rest on the inner surfaces of the upper and lower chords 18 and 20 and are welded to the chords along the width of the respective chords. However, where the panels are to be used in association with heavy bearing loads, the construction such as illustrated in FIG. 5 can be utilized. In this case, a pair of spaced-apart slots 58 are provided in the upper surfaces of the lower chord 18, the spaced-apart slots 58 receiving downwardly projecting wall portions 60 extending downwardly from a lower surface of the vertical stud 22. The height of the projecting wall portions 60 corresponds to the depth of the tubular steel chord 18 such that a lower surface of the projecting wall portions 60 is situated adjacent to the lower surface of the lower chord 18. In this position, the projecting wall portions are welded to the chord. In this way, axial loading in the vertical stud 22 is transferred to the lower surface of the lower chord 18, which rests directly on the surface of the poured concrete floor. As a result, the bearing loads are transferred directly to the concrete floor, thereby preventing collapse of the lower chord in the situation where the lower surface of the vertical stud rests on the upper surface of the lower chord. The same construction is also used for studs connected to upper chord 20 in a reverse manner.

After installation of the temporary shoring and the laying in position of the plywood, concrete is then poured over the plywood surface. By utilizing the channel members 46, it is possible to avoid the use of screw-type jacks to support the plywood in position during pouring and curing of the concrete. The installation of the jacks and the fact that a large number of such jacks are necessary to support the concrete associated with known methods of building construction is avoided by the present invention. After curing of the concrete, the temporary shoring is removed by undoing bolts 50 so as to permit removal of the channel members 46 and the plywood 56, which is supported thereby. Gypsum or plaster board could then be applied to the outer surfaces of the panels 16 by first attaching directly to the vertical studs 22 or by attaching sheet metal channels 62 to the vertical studs 22, as best seen in FIG. 1. The sheet metal channel 62 is attached to the vertical studs by means of suitable fasteners 64 and clips can be utilized for attaching the plaster board 66 to the sheet metal channels 62.

The prefabricated steel panels 16 are made of either rectangular or square cross-sectional tubular members which are welded together. The square or rectangular cross-sectional tubular members provide optimal transfer of bearing loads to the concrete floor, as well as providing flat surfaces to which plaster boards or similar paneling could be attached. Additionally, the most efficient steel section to support heavy loading such as in the present application has been found to be a hollow tubular member which is either square or rectangular in cross-section. The rectangular section provides an optimum strength to weight ratio in comparison to I-beam or channel sections which are much heavier and more expensive and which must be stiffened by horizontal bridging and diagonal bracing.

It is also within the scope of the present invention to utilize prefabricated metal panels which have already been provided with Gyproc prior to installation thereof at the site. In this way, it would be possible to minimize the expense associated with on site construction to simply securing the panels in position by means of nuts.

I claim:

1. A multi-storey building having a foundation and a roof, the building comprising a plurality of poured concrete floors, the poured concrete floors being separated by parallel walls, each wall comprising a row of a plurality of prefabricated panels made up of structural tubular members, the panels extending from one floor to a next adjacent floor, each panel having parallel upper and lower chords, each wall being in vertical alignment with corresponding wall situated on vertically adjacent floors, each vertically adjacent wall being interconnected by high-tensile strength fasteners rigidly interconnecting the upper chord of each panel to an adjacent lower chord of a vertically adjacent panel, each fastener having a length at least greater than the combined thickness of the upper and lower chords of vertically adjacent panels and the floor therebetween, the rows of vertically interconnected prefabricated panels providing effective continuous lightweight bearing walls extending from the foundation of the building to the roof thereof, the bearing walls supporting loads imposed on the building and providing stiffness to the building.

2. A multi-storey building according to claim 1, wherein horizontal adjacent prefabricated panels in each row are interconnected by means of threaded fasteners.

3. A multi-storey building according to claim 1, wherein space between adjacent chords of vertically adjacent panels is separated by reinforced concrete floors, the reinforced concrete floors adapted to transfer shear forces and bearing loads to the parallel walls.

4. A multi-storey building according to claim 1, wherein horizontally adjacent walls formed from prefabricated panels are interconnected by structural girders, the opposite ends of each girder being supported on an upper surface of an upper chord, at least some of the girders being rigidly connected to the prefabricated steel panels to provide support for the rows of walls, an upper portion of each girder being located in the poured concrete floor, the girders permitting use of a thinner poured concrete floor.

5. A multi-storey building according to claim 1, wherein a lower surface of the lower chord of each panel rests on the poured concrete floor and is forced thereagainst by the high tensile strength fasteners which are threaded to receive tightening nuts.

6. A prefabricated tubular metal panel utilized in constructing walls on a multi-storey building, the panel having an upper chord and a lower chord which is parallel thereto, the upper and lower chords being of identical tubular metal construction and being rigidly connected together by a plurality of tubular metal studs, each stud extending between the upper and lower chords and being welded at opposite ends thereof to inner flat surfaces of the upper and lower chords, the upper and lower chords of the panel having aligned openings therein, the openings on the upper chord supporting high-tensile strength threaded fasteners, end portions of which extend away from the upper chord, threaded fasteners adapted to fit aligned openings in a lower chord of a further prefabricated panel, at least one of the studs being provided with integral longitudinally projecting wall segments, the wall segments fitting into cooperating slots located in an inner surface of the lower chord, an outer edge of each wall segment being welded to an outer surface of the lower chord, whereby bearing loads in the stud are transferred through the stud and its integral wall segments to the outer surface of the lower stud which is adapted to rest on a poured concrete floor, thereby transferring heavy loads in the stud to the poured concrete floor.

7. The method of constructing a multi-storey building comprising the steps of:

(a) prefabricating a plurality of tubular steel panels, each panel having an upper chord and a lower chord, the upper and lower chords being rigidly interconnected by parallel studs, opposite ends of each stud being welded to an inner surface of the upper and lower chords, the upper and lower chords having aligned openings therein which receive threaded fasteners;

(b) placing threaded fasteners in the openings situated in the upper chords whereby an end portion of each threaded fastener extends outwardly beyond an outer surface of the upper chord, the threaded fasteners being secured in position to the upper chord to prevent rotation thereof;

(c) transporting the prefabricated panels to the building site;

(d) erecting the prefabricated panels in position on an already poured concrete floor by locating each panel such that the openings in the lower chord are situated on the portions of the threaded fasteners extending upwardly from a corresponding prefabricated panel situated beneath the floor and supporting the same, the portion of the threaded fastener extending above the surface of the floor and above an inner surface of the lower chord of the panel situated thereon, and applying securing means to the threaded fasteners so as to secure each prefabricated panel in position;

(e) erecting a support structure between erected rows of self-supporting erected prefabricated panels forming parallel rows of walls, and placing a temporary supporting surface on the erected support structure;

(f) pouring concrete onto the temporary supporting surface so as to form a floor of the multi-storey building; and (g) removing the temporary supporting surface after the poured concrete floor has hardened.

8. A method according to claim 7, including the step of interconnecting end studs of each prefabricated panel to adjacent end studs of adjacent panels in a row of panels by means of suitable fasteners.

9. A method according to claim 7, wherein the support structure comprises steel girders extending between adjacent rows of prefabricated panels and opposite end of each steel girder resting on an upper surface of the upper chord of the prefabricated panel, some of the steel girders being welded to the prefabricated panels in order to provide lateral permanent support for the prefabricated panels.

10. A method according to claim 7, wherein the support structure comprises temporary shoring which is releasably interconnected to the prefabricated panels and is removed after curing of the poured concrete floor, together with the temporary supporting surface.

11. A method according to claim 10, wherein the temporary shoring comprises steel channel members having elongated slots adjacent opposite ends thereof, opposite ends of each channel member being interconnected with a further channel member by means of bolts extended through the elongated slots, flat back surfaces of the channel members bearing against the tubular metal stud of the prefabricated panel and being supported therefrom by means of ledge portions rigidly secured to the studs and spaced beneath the upper chord of the panel.

* * * * *